US012060890B1

(12) United States Patent
Zeng et al.

(10) Patent No.: US 12,060,890 B1
(45) Date of Patent: Aug. 13, 2024

(54) FAN BLADE ASSEMBLY AND FAN APPARATUS

(71) Applicant: GD MIDEA ENVIRONMENT APPLIANCES MFG CO., LTD., Zhongshan (CN)

(72) Inventors: Junfeng Zeng, Zhongshan (CN); Shiqiang Cui, Zhongshan (CN)

(73) Assignee: GD MIDEA ENVIRONMENT APPLIANCES MFG CO., LTD., Zhongshan (CN)

( * ) Notice: Subject to any disclaimer, the term of this patent is extended or adjusted under 35 U.S.C. 154(b) by 0 days.

(21) Appl. No.: 18/482,873

(22) Filed: Oct. 7, 2023

(30) Foreign Application Priority Data

Mar. 3, 2023 (CN) ..... 202320383094.X

(51) Int. Cl.
*F04D 29/38* (2006.01)
*F04D 17/02* (2006.01)
*F04D 29/32* (2006.01)
*F04D 29/66* (2006.01)

(52) U.S. Cl.
CPC ..... *F04D 29/388* (2013.01); *F04D 17/025* (2013.01); *F04D 29/329* (2013.01); *F04D 29/667* (2013.01)

(58) Field of Classification Search
CPC ..... F04D 29/388; F04D 29/329
See application file for complete search history.

(56) References Cited

U.S. PATENT DOCUMENTS

2005/0063825 A1* 3/2005 Yang ..... F04D 29/329 416/183
2010/0260608 A1* 10/2010 Suzuki ..... F04D 29/34 416/204 R
2012/0244008 A1* 9/2012 Chang ..... F04D 29/666 416/244 R
2016/0131160 A1* 5/2016 Bai ..... F04D 29/526 417/423.14

* cited by examiner

*Primary Examiner* — Brian O Peters

(57) ABSTRACT

Provided in embodiments of the present disclosure are a fan blade assembly and a fan apparatus. The fan blade assembly includes: a primary fan blade, where multiple first blades circumferentially provided are arranged on the primary fan blade; an auxiliary fan blade arranged coaxial and adjacent to the primary fan blade, where multiple second blades circumferentially provided are arranged on the auxiliary fan blade, an air inlet direction of the auxiliary fan blade is an axial direction, an air outlet direction of the auxiliary fan blade is a radial direction, and the first blades and the second blades have different torsion directions; and an motor arranged on one side of the auxiliary fan blade away from the primary fan blade, where the primary fan blade has a maximum outer diameter greater than an outer diameter of the auxiliary fan blade. According to the embodiment of the present disclosure.

14 Claims, 2 Drawing Sheets

FAN BLADE ASSEMBLY AND FAN APPARATUS

CROSS-REFERENCES TO RELATED APPLICATIONS

The present disclosure claims the priority of Chinese Patent Application No. 202320383094.X, filed with the Chinese Patent Office on Mar. 3, 2023, the entireties of which are herein incorporated by reference.

FIELD

The present disclosure relates to the field of fans, and in particular to a fan blade assembly and a fan apparatus.

BACKGROUND

Currently, a motor of a fan will generate noise during operation in the related art. In a case in which a user needs a quiet environment, the fan will bore the user all through its operation with the noise, and then user experience is reduced.

SUMMARY

The present disclosure aims to at least solve one of the problems existing in the prior art or related art.

In view of this, an embodiment of the present disclosure provides a fan blade assembly.

An embodiment of the present disclosure provides a fan apparatus.

In order to achieve the above objective, the embodiment of the present disclosure provides the fan blade assembly. The fan blade assembly includes: a primary fan blade with multiple first blades circumferentially arranged thereon; an auxiliary fan blade adjacent coaxially to the primary fan blade, where mutiple second blades circumferentially provided are arranged on the auxiliary fan blade, and the first blades and the second blades have different torsion directions; and a motor arranged on one side of the auxiliary fan blade away from the primary fan blade, where the primary fan blade has a maximum outer diameter greater than an outer diameter of the auxiliary fan blade.

The fan blade assembly according to the present disclosure mainly includes the motor and two fan blades coaxially arranged. One of the fan blades is the primary fan blade, which may discharge air towards a front side during rotation, to ensure normal air supply. The other one of the fan blades is the auxiliary fan blade. In a process that the primary fan blade normally rotates to supply air, since the first blades and the second blades have different torsion directions and an air inlet direction of the auxiliary fan blade is perpendicular to an air outlet direction of the auxiliary fan blade, the air outlet direction of the auxiliary fan blade may be perpendicular to the air inlet direction of the auxiliary fan blade in a process of rotation in the same direction, and belongs to dispersed radial air outlet, and incoming flow impact of the primary fan blade may be reduced to reduce noise. Moreover, the primary fan blade normally supplies air towards the front side, and the auxiliary fan blade may generate negative pressure during rotation, and air at the motor flows to have a heat dissipation effect on the motor located on a rear side to some extent. That is, the primary fan blade, the auxiliary fan blade and the motor are sequentially arranged in the axial direction, the primary fan blade may supply air towards the front side during rotation, and the auxiliary fan blade controls air around the motor to flow by negative pressure during rotation, and then heat dissipation near the motor is accelerated, and decelerating temperature rise of the motor. It should be noted that the mutiple first blades are arranged on the primary fan blade, and the multiple first blades are arranged in a circumferential direction, and during rotation, the primary fan blade may continuously supply air towards the front side under the action of the first blades. Similarly, for the auxiliary fan blade, the multiple second blades are arranged on the auxiliary fan blade, and the second blades and the first blades have different torsion directions. When the auxiliary fan blade and the primary fan blade rotate accordingly, the auxiliary fan blade may generate radial air flow to increase an air inlet amount and increase an air speed. The air flow is divided by the auxiliary fan blade, and air is discharged by the primary fan blade, and discharged air is delicate and gentle, and then user comfort is improved.

It should be emphasized that in the present application, the maximum outer diameter of the primary fan blade is limited to be greater than the outer diameter of the auxiliary fan blade, and when the primary fan blade and the auxiliary fan blade simultaneously rotate under a driving effect of the motor, rotation of the primary fan blade mainly supplying air may better satisfy heat dissipation and air blowing requirements of a user, and the auxiliary fan blade having a smaller size may reduce an effect of the auxiliary fan blade on a flow field of the primary fan blade, to ensure flow efficiency and reduce noise.

In the embodiment, the auxiliary fan blade is arranged on an air inlet side of the primary fan blade.

In the embodiment, the auxiliary fan blade is arranged on the air inlet side of the primary fan blade, and air may flow to the primary fan blade from one side of the auxiliary fan blade when the primary fan blade rotates. In this case, since the first blades and the second blades have different torsion directions, the incoming flow impact of the primary fan blade may be effectively reduced by using opposite torsion directions, and when the auxiliary fan blade and the primary fan blade rotate accordingly, the second blades and the first blades have different air supply directions. The auxiliary fan blades may generate radial air flow to increase the air inlet amount and increase the air speed, the air flow is divided by the auxiliary fan blade, and air is discharged by the primary fan blade, and discharged air is delicate and gentle, and then user comfort is improved.

Generally, the primary fan blade has a forward air supply direction, and the air inlet side is a rear side of the primary fan blade. The auxiliary fan blade is arranged at the rear side of the primary fan blade, and after rotation, the auxiliary fan blade may provide supplementary inlet air for the primary fan blade along with rotation of the auxiliary fan blade, to increase the air inlet amount and increase the air speed.

In the embodiment, the hub diameter of the primary fan blade is greater than the maximum diameter of the auxiliary fan blade.

In the embodiment, the diameter of the auxiliary fan blade is limited to be smaller than the hub diameter of the primary fan blade, and an effect of the auxiliary fan blade on the flow field of the primary fan blade may be further reduced, and noise increase caused by an effect of the flow field may be reduced, and then user experience is improved.

Moreover, the number of the first blades is smaller than that of the second blades, and the number of the first blades is relatively prime to that of the second blades. The number of the first blades and the number of the second blades are limited, that is, the number of the first blades is small, and the number of the two blades is relatively prime, and superposition of a fundamental frequency may be effectively reduced, and then generation of noise is avoided.

In the embodiment, the transparency of the primary fan blade is greater than 10%.

In the embodiment, the transparency of the primary fan blade is limited, and the primary fan blade is semi-transparent or fully transparent to provide a viewing window for the user, to intuitively view an operation condition inside a fan, and then subsequent maintenance and replacement are facilitated.

In the embodiment, the fan blade assembly further includes: a motor shaft arranged on the motor, where the primary fan blade is in transmission connection with the motor shaft of the motor, and the auxiliary fan blade is in transmission connection with the motor shaft.

In the embodiment, the motor shaft is arranged on the motor, the primary fan blade and the auxiliary fan blade are both in transmission connection with the motor shaft, and when the motor shaft rotates, the primary fan blade and the auxiliary fan blade may be driven to rotate in the same direction, and an air amount of supply air to the front side may be considered by only one motor, a weight of the entire fan blade assembly is reduced, and moreover, the number of parts is further reduced.

In embodiment, a flat shaft part is arranged on the motor shaft, and the primary fan blade is in transmission connection with the motor shaft by the flat shaft part.

In the embodiment, the flat shaft part is arranged on the motor shaft, and the primary fan blade may fit the flat shaft part, to be in transmission connection with the motor shaft. In an embodiment, a section of the flat shaft part on the motor shaft may be in a D shape, an X shape or even any non-perfect circle. A hole having a corresponding shape is provided in a center of the primary fan blade. The primary fan blade is inserted into the flat shaft part, and when the motor shaft rotates, the primary fan blade may be driven to rotate accordingly.

In the embodiment, positioning shafts extending outwards in the radial direction are arranged on the motor shaft, positioning grooves adapted to the positioning shafts are provided on the auxiliary fan blade, and the auxiliary fan blade is circumferentially positioned by fit of the positioning shafts and the positioning grooves.

In the embodiment, the positioning shafts extending in the radial direction are arranged on the motor shaft to mount and position the auxiliary fan blade. The positioning grooves are provided on the auxiliary fan blade. When the auxiliary fan blade is to be mounted on the motor shaft, mounting may be completed by fit of the positioning grooves and the positioning shafts. During rotation, the positioning shafts may drive the auxiliary fan blade to rotate accordingly. In one embodiment, since the positioning shafts on the motor shaft extend in the radial direction, the positioning grooves are located in the center of the auxiliary fan blade, and are formed by extension in the radial direction. During fit, the positioning grooves of the auxiliary fan blade may be aligned with the positioning shafts on the motor shaft. If there is a circumferential deviation, the positioning shafts may be aligned with the positioning grooves and then mounted and matched by rotating the auxiliary fan blade.

Further, two or more of the positioning shafts may be arranged. The positioning shafts are uniformly arranged in the circumferential direction, and a circumferential force applied to the auxiliary fan blade is uniform.

In the embodiment, the fan blade assembly further includes: a locking member, where a first threaded member is arranged on the locking member, an end part of the motor shaft is provided with an external thread, and the locking member is fastened by fit of the external thread and the first threaded member.

In the embodiment, the locking member is arranged, and the primary fan blade and the auxiliary fan blade on the motor shaft may be axially fixed by threaded connection, and then a possibility of noise generated by axial movement during rotation is reduced. In an embodiment, the first threaded member is arranged on the locking member, the external thread is arranged at an end part of the motor shaft, and the external thread is arranged at one end of the motor shaft extending out of the motor. After the auxiliary fan blade and the primary fan blade are sequentially mounted, positions of the primary fan blade and the auxiliary fan blade may be limited by mounting the locking member.

In the embodiment, the fan blade assembly further includes: a first damping member arranged on one side of the primary fan blade facing the auxiliary fan blade; and a second damping member arranged on one side of the primary fan blade facing away from the auxiliary fan blade.

In the embodiment, two axial sides of the primary fan blade are each provided with one damping member, and vibration generated by the two fan blades is absorbed, and vibration and noise of the entire fan blade assembly are reduced advantageously. In an embodiment, the first damping member is arranged between the primary fan blade and the auxiliary fan blade, and the second damping member is arranged between the primary fan blade and the locking member, to suppress vibration and noise that are possibly generated in the axial direction.

Further, the first damping member and the second damping member may be made of rubber or other materials having a buffering property, and may be in the form of a sealing ring or a sealing gasket.

The embodiment of the present disclosure provides the fan apparatus. The fan apparatus includes: a motor support; and the fan blade assembly of any one of the embodiments described above that is arranged on the motor support.

The fan apparatus according to the present disclosure includes the motor support and the fan blade assembly, where the motor support may support the fan blade assembly.

Further, heat dissipation holes are provided on the motor support, and air blown by the auxiliary fan blade may be directly blown to the motor, and then heat of air around the motor is effectively dissipated.

Since the fan apparatus includes the fan blade assembly, the fan apparatus has the beneficial effects of any fan blade assembly in the embodiments, which will not be repeated herein.

The fan apparatus includes, but not limited to, a floor fan, a tower fan, a circulating fan, etc.

In the embodiment, the fan apparatus includes: a first net cover and a second net cover that are detachable, where the first net cover and the second net cover are connected to form an housing cavity, with the fan blade assembly arranged in the housing cavity, the first net cover is arranged on the air outlet side of the primary fan blade of the fan blade assembly, and sound absorption holes are provided on a peripheral wall of the second net cover.

In the embodiment, the first net cover and the second net cover are arranged, and after the two detachable net covers are connected, the housing cavity configured to accommodate the fan blade assembly is formed, and moreover, the first net cover and the second net cover further have a protective effect on the primary fan blade and the auxiliary fan blade to some extent, and then use safety is improved.

Moreover, since the first net cover and the second net cover are hollowed out, normal air inlet and air supply may be ensured.

It should be noted that the sound absorption holes are provided at the second net cover located on a rear side, and noise generated when the auxiliary fan blade impacts an inner wall during rotation may be effectively reduced.

Further, an opening size of the sound absorption holes is gradually increased from front to back in the axial direction, and the sound absorption holes are uniformly distributed in the circumferential direction, and sound absorption and noise reduction effects may be further improved.

Further, the first net cover located on a front side is configured to be transparent, and it is convenient for the user to view an internal structure during operation. Moreover, assembly and positioning during mounting are facilitated, and then mounting efficiency is improved.

In the embodiment, the fan apparatus further includes: a floor stand, where the motor support is arranged at one end of the floor stand.

In the embodiment, the motor support is arranged at one end of the floor stand, and the fan blade assembly is arranged on the floor stand, the entire fan apparatus is in the form of the floor fan, and an air outlet height is in line with use habits of the user.

In the embodiment, the sound absorption holes are arranged along the circumferential direction of the second net cover.

In the embodiment, the sound absorption holes are arrayed in the circumferential direction of the second net cover, and sound absorption and noise reduction effects may be further improved during rotation.

In the embodiment, the size of the sound absorption holes is gradually increased or decreased from the first net cover to the second net cover in an axial direction of the fan blade assembly.

In the embodiment, the opening size of the sound absorption holes is monotonically changed from front to back in the axial direction, and sound absorption and noise reduction effects may be further improved.

In the embodiment, the second net cover is arranged close to the motor of the fan blade assembly, the first net cover is provided with a first transparent area, and the fan blade assembly is provided with a second transparent area.

In the embodiment, the second net cover is arranged on a rear side of an entire structure, the first net cover is arranged at a front side of the whole structure, the first transparent area is arranged on the first net cover, and the second transparent area is further arranged in the fan blade assembly, and the user may conveniently view the internal structure. In one embodiment, in the presence of dust in the internal fan blades, the user may see the dust in time from the transparent area, to replace the fan blades in time.

Further, the first transparent area is arranged on an inner side of the first net cover, the second transparent area is arranged at a middle part of the first blades, and the first transparent area matches the second transparent area to achieve a perspective effect.

Embodiments of the present disclosure will become apparent in the following description, or may be learned by practice of the present disclosure.

Figure 1:
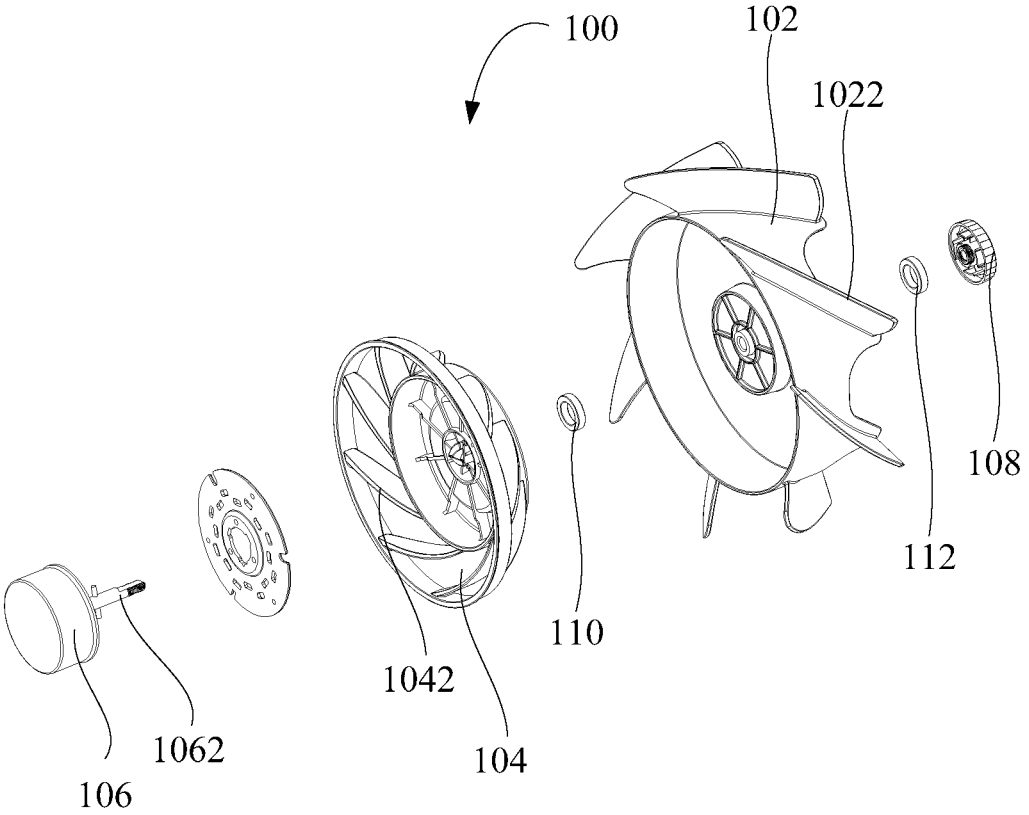
FIG. 1 shows a schematic structural diagram of a fan blade assembly according to an embodiment of the present disclosure.
Figure 2:
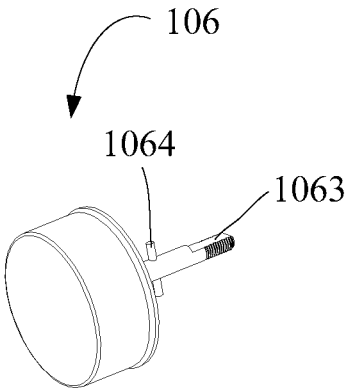
FIG. 2 shows a schematic structural diagram of a motor according to an embodiment of the present disclosure.
Figure 3:
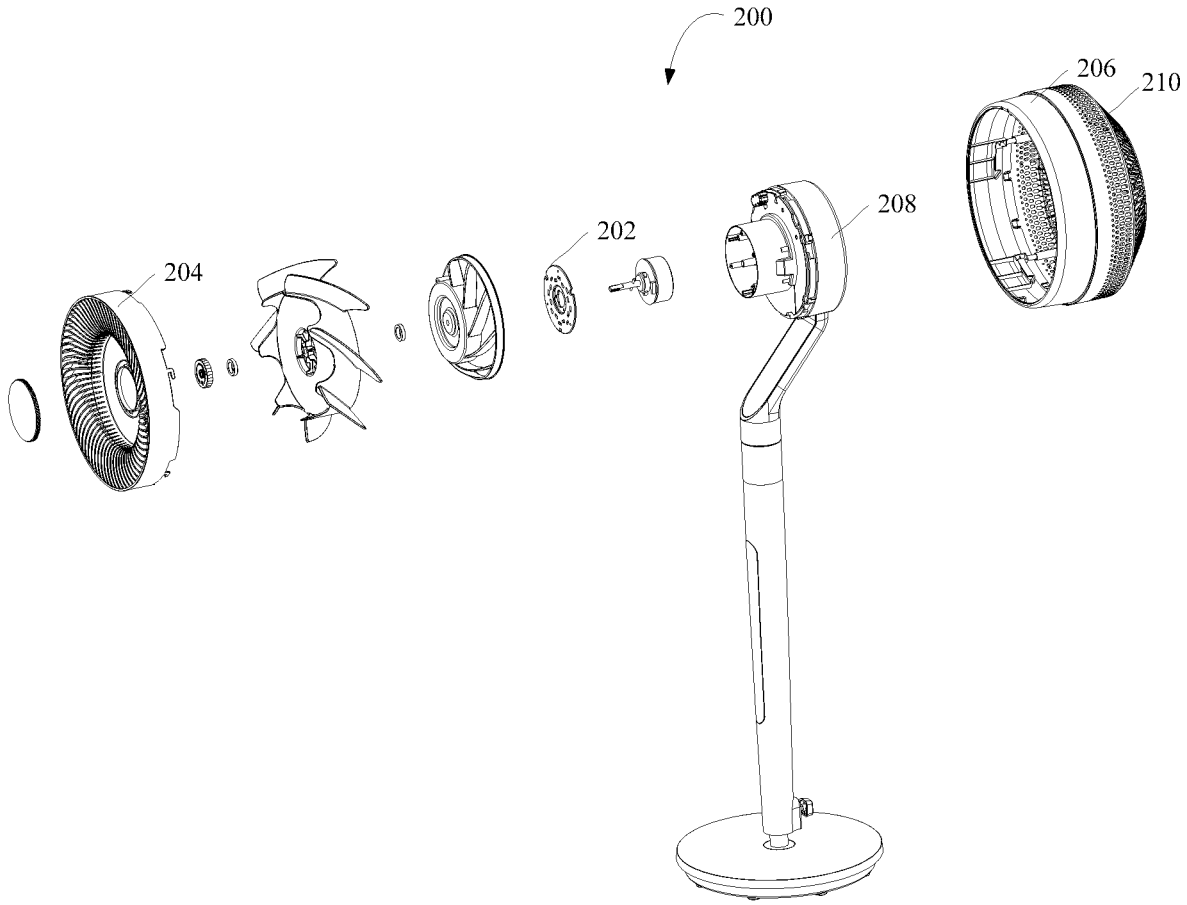
FIG. 3 shows a schematic structural diagram of a fan apparatus according to an embodiment of the present disclosure.

Corresponding relations between reference numerals and component names in FIGS. 1-3 are as follows:

100: fan blade assembly; 102: primary fan blade; 1022: first blade; 104: auxiliary fan blade; 1042: second blade; 106: motor; 1062: motor shaft; 1063: flat shaft part; 1064: positioning shaft; 108: locking member; 110: first damping member; 112: second damping member;

200: fan apparatus; 202: motor support; 204: first net cover; 206: second net cover; 208: floor stand; and 210: sound absorption hole.

DETAILED DESCRIPTION OF THE DISCLOSURE

In order to make the embodiments of the present disclosure clearer and more comprehensible, the embodiments of the present disclosure will be further described in detail below with reference to the accompanying drawings and the specific implementations. It should be noted that the embodiments in the present application and features in the embodiments can be combined with one another without conflict.

Many details are set forth in the following description to facilitate full understanding of the present application, but the embodiments of the present disclosure can further be implemented in other ways different from those described herein, and therefore the scope of protection of the present application is not limited to the particular embodiments disclosed below.

Some embodiments according to the present disclosure are described with reference to FIGS. 1-3 below.

Embodiment 1

As shown in FIG. 1, a fan blade assembly 100 according to the embodiment mainly includes a motor 106 and two fan blades coaxially arranged. One of the fan blades is a primary fan blade 102, which may discharge air towards a front side during rotation, to ensure normal air supply. The other one of the fan blades is an auxiliary fan blade 104. In a process that the primary fan blade 102 normally rotates to supply air, since first blades 1022 and second blades 1042 have different torsion directions and an air inlet direction of the auxiliary fan blade is perpendicular to an air outlet direction of the auxiliary fan blade, the air outlet direction of the auxiliary fan blade may be perpendicular to the air inlet direction of the auxiliary fan blade in a process of rotation in the same direction, and belongs to dispersed radial air outlet, and incoming flow impact of the primary fan blade may be reduced to reduce noise. Moreover, the primary fan blade 102 normally supplies air towards the front side, and the auxiliary fan blade 104 may generate negative pressure during rotation, and air at the motor flows to have a heat dissipation effect on the motor 106 located on a rear side to some extent. That is, the primary fan blade 102, the auxiliary fan blade 104 and the motor 106 are sequentially arranged in the axial direction, the primary fan blade 102 may supply air towards the front side during rotation, and the auxiliary fan blade 104 controls air around the motor to flow by negative pressure during rotation, and then heat dissipation near the motor 106 is accelerated, and temperature rise of the motor 106 is decelerated.

It should be emphasized that in the present application, the primary fan blade and the auxiliary fan blade are connected to a motor shaft of the motor together. A first damping member and/or a second damping member are/is arranged on the motor shaft, and a phenomenon of head shaking that possibly occurs may be greatly alleviated, noise may be further reduced, and operation of the entire fan blade assembly is stabler and more balanced.

It should be noted that the multiple first blades 1022 are arranged on the primary fan blade 102, and the multiple first blades 1022 are arranged in a circumferential direction, and during rotation, the primary fan blade 102 may continuously supply air towards the front side under the action of the first blades 1022. Similarly, for the auxiliary fan blade 104, the multiple second blades 1042 are arranged on the auxiliary fan blade 104, and the second blades 1042 and the first blades 1022 have different torsion directions. When the auxiliary fan blade 104 and the primary fan blade 102 rotate accordingly, an air supply direction of the second blades 1042 is perpendicular to that of the first blades 1022, and in a process of normal air supply of the primary fan blade 102 to the front side, the auxiliary fan blade 104 may have an effect of excellent heat dissipation on the motor 106 located on a rear side.

In the present application, a maximum outer diameter of the primary fan blade is limited to be greater than an outer diameter of the auxiliary fan blade, and when the primary fan blade and the auxiliary fan blade simultaneously rotate under a driving effect of the motor, rotation of the primary fan blade mainly supplying air may better satisfy heat dissipation and air blowing requirements of a user, and the auxiliary fan blade having a smaller size may reduce an effect of the auxiliary fan blade on a flow field of the primary fan blade, to ensure flow efficiency and reduce noise.

In a particular embodiment, the auxiliary fan blade 104 is arranged on an air inlet side of the primary fan blade 102, and air may flow to the primary fan blade 102 from one side of the auxiliary fan blade 104 when the primary fan blade 102 rotates. In this case, since the first blades 1022 and the second blades 1042 have different torsion directions, the incoming flow impact of the primary fan blade may be effectively reduced by using opposite torsion directions, and when the auxiliary fan blade and the primary fan blade rotate accordingly, the second blades and the first blades have different air supply directions. The auxiliary fan blades may generate radial air flow to increase the air inlet amount and increase the air speed, the air flow is divided by the auxiliary fan blade, and air is discharged by the primary fan blade, and discharged air is delicate and gentle, and then user comfort is improved.

Generally, the primary fan blade 102 has a forward air supply direction, and the air inlet side is a rear side of the primary fan blade 102. The auxiliary fan blade 104 is arranged at the rear side of the primary fan blade 102, and after rotation, the auxiliary fan blade may provide supplementary inlet air for the primary fan blade along with rotation of the auxiliary fan blade 104, to increase the air inlet amount and increase the air speed.

Further, the hub diameter of the primary fan blade is greater than the maximum diameter of the auxiliary fan blade, and an effect of the auxiliary fan blade on the flow field of the primary fan blade may be further reduced, and noise increase caused by an effect of the flow field may be reduced, and then user experience is improved.

In a particular embodiment, a fan blade assembly 100 is provided. The fan blade assembly mainly includes a motor 106 and two fan blades coaxially arranged. One of the fan blades is a primary fan blade 102, which may discharge air towards a front side during rotation, to ensure normal air supply. The other one of the fan blades is the auxiliary fan blade 104. In a process that the primary fan blade 102 normally rotates to supply air, since the first blades 1022 and the second blades 1042 have different torsion directions, the primary fan blade 102 and the auxiliary fan blade 104 have different air supply directions in a process of rotation in the same direction. The primary fan blade 102 normally supplies air to the front side, and the auxiliary fan blade 104 generates negative pressure during rotation, and air at the motor flows to have a heat dissipation effect on the motor 106 located on the rear side to some extent. That is, the primary fan blade 102, the auxiliary fan blade 104 and the motor 106 are sequentially arranged in the axial direction, the primary fan blade 102 may supply air towards the front side during rotation, and air generated by the auxiliary fan blade 104 during rotation flows through the motor, and then heat dissipation near the motor 106 is accelerated, and temperature rise of the motor 106 is decelerated.

For the motor 106, a motor shaft 1062 is arranged on the motor 106, the primary fan blade 102 and the auxiliary fan blade 104 are both in transmission connection with the motor shaft 1062, and when the motor shaft 1062 rotates, the primary fan blade 102 and the auxiliary fan blade 104 may be driven to rotate in the same direction, and an air amount of supply air to the front side may be considered by only one motor 106, a weight of the entire fan blade assembly 100 is reduced, and moreover, the number of parts is further reduced.

Further, as shown in FIG. 2, a flat shaft part 1063 is arranged on a motor shaft 1062, and a primary fan blade 102 may fit the flat shaft part, to be in transmission connection with the motor shaft. In an embodiment, a section of the flat shaft part 1063 on the motor shaft 1062 may be in a D shape, an X shape or even any non-perfect circle. A hole having a corresponding shape is provided in a center of the primary fan blade 102. The primary fan blade 102 is inserted into the flat shaft part 1063, and when the motor shaft 1062 rotates, the primary fan blade 102 may be driven to rotate accordingly.

In an embodiment, positioning shafts 1064 extending in the radial direction are arranged on the motor shaft 1062 to mount and position the auxiliary fan blade 104. Positioning grooves are provided on the auxiliary fan blade 104, and when the auxiliary fan blade 104 is to be mounted on the motor shaft 1062, mounting may be completed by fit of the positioning grooves and the positioning shafts 1064. During rotation, the positioning shafts 1064 may drive the auxiliary fan blade 104 to rotate accordingly. In one embodiment, since the positioning shafts 1064 on the motor shaft 1062 extend in the radial direction, the positioning grooves are located in the center of the auxiliary fan blade 104, and are formed by extension in the radial direction. During fit, the positioning grooves of the auxiliary fan blade 104 may be aligned with the positioning shafts 1064 on the motor shaft 1062. If there is a circumferential deviation, the positioning shafts 1064 may be aligned with the positioning grooves and then mounted and matched by rotating the auxiliary fan blade 104.

Further, two or more of the positioning shafts 1064 may be arranged. The positioning shafts 1064 are uniformly arranged in the circumferential direction, and a circumferential force applied to the auxiliary fan blade 104 is uniform.

In another embodiment, both a flat shaft part 1063 and positioning shafts 1064 are arranged on a motor shaft 1062, and a primary fan blade 102 and an auxiliary fan blade 104 are connected and fixed.

On the basis of any embodiment, the locking member 108 is arranged, and the primary fan blade 102 and the auxiliary fan blade 104 on the motor shaft 1062 may be axially fixed by threaded connection, and then a possibility of noise generated by axial movement during rotation is reduced. In an embodiment, a first threaded member is arranged on the locking member 108, an external thread is arranged at an end part of the motor shaft 1062, and the external thread is arranged at one end of the motor shaft 1062 extending out of the motor 106. After the auxiliary fan blade 104 and the primary fan blade 102 are sequentially mounted, positions of the primary fan blade 102 and the auxiliary fan blade 104 may be limited by mounting the locking member 108.

Further, in an embodiment, a first damping member 110 is arranged.

In another embodiment, a second damping member 112 is arranged.

In another embodiment, both a first damping member 110 and a second damping member 112 are arranged, and two axial sides of a primary fan blade 102 are each provided with one damping member, and vibration generated by the two fan blades is absorbed, and vibration and noise of the entire fan blade assembly are reduced advantageously. In an embodiment, the first damping member 110 is arranged between the primary fan blade 102 and an auxiliary fan blade 104, and the second damping member 112 is arranged between the primary fan blade 102 and a locking member 108, to suppress vibration and noise that are possibly generated in the axial direction.

Further, the first damping member 110 and the second damping member 112 may be made of rubber or other materials having a buffering property, and may be in the form of a sealing ring or a sealing gasket.

On the basis of any embodiment described above, transparency of the primary fan blade is limited to exceed 10%, and the primary fan blade is semi-transparent or fully transparent to provide a viewing window for the user, to intuitively view an operation condition inside a fan, and then subsequent maintenance and replacement is facilitated.

Embodiment 2

As shown in FIG. 3, the embodiment provides a fan apparatus 200. The fan apparatus includes a motor 106 support and a fan blade assembly 100, where the motor 106 support may support the fan blade assembly 100.

Further, heat dissipation holes are provided on the motor support 106, and air blown by the auxiliary fan blade 104 may flow through the motor 106, and then heat of air around the motor 106 is effectively dissipated.

Since the fan apparatus 200 includes the fan blade assembly 100, the fan apparatus has the beneficial effects of any fan blade assembly 100 in the embodiments, which will not be repeated herein.

The fan apparatus 200 includes, but not limited to, a floor fan, a tower fan, a circulating fan, etc.

Further, as shown in FIG. 3, a fan apparatus further includes: a first net cover 204 and a second net cover 206 that are detachable, where the first net cover 204 and the second net cover 206 are connected to form a housing cavity, and a fan blade assembly 100 is arranged in the housing cavity. The first net cover 204 and the second net cover 206 are arranged, and after the two detachable net covers are connected, the housing cavity configured to accommodate the fan blade assembly 100 is formed, and moreover, the first net cover 204 and the second net cover 206 further have a protective effect on the primary fan blade 102 and the auxiliary fan blade 104 to some extent, and then use safety is improved. Moreover, since the first net cover 204 and the second net cover 206 are hollowed out, normal air inlet and air supply may be ensured.

The first net cover is arranged on the air outlet side of the primary fan blade of the fan blade assembly, and a middle ring part of the first net cover has transparency greater than 10%. The transparency of the first net cover located on the front side is configured, and it is convenient for the user to view the internal structure during operation. Moreover, assembly and positioning during mounting are facilitated, and then mounting efficiency is improved.

In one embodiment, since the first net cover and the primary fan blade that are transparent are used, a novel appearance may be formed, and then differentiation of a product is improved advantageously.

Further, the fan apparatus further includes: a floor stand 208, where the motor 106 support is arranged at one end of the floor stand 208. The motor support 106 is arranged at one end of the floor stand 208, and the fan blade assembly 100 is arranged on the floor stand 208, the entire fan apparatus 200 is in the form of the floor fan, and an air outlet height is in line with use habits of the user.

Sound absorption holes 210 are arranged along the circumferential direction of the second net cover.

Further, the size of the sound absorption holes 210 is gradually increased or decreased from the first net cover to the second net cover in an axial direction of the fan blade assembly.

Further, the second net cover is arranged on a rear side of a whole structure, the first net cover is arranged at a front side of the whole structure, a first transparent area is arranged on the first net cover, and a second transparent area is further arranged in the fan blade assembly, and the user may conveniently view the internal structure. In one embodiment, in the presence of dust in the internal fan blades, the user may see the dust in time from the transparent area, to replace the fan blades in time.

Further, the first transparent area is arranged on an inner side of the first net cover, the second transparent area is arranged at a middle part of the first blades, and the first transparent area matches the second transparent area to achieve a perspective effect.

In a particular embodiment, a heat dissipation structure for a motor 106 of a fan is provided. A primary fan blade 102 is configured to blow air from a front net cover for use by a user, and an auxiliary fan blade 104 is mounted at a rear of the primary fan blade 102, and is configured to dissipate heat of the motor 106. A shockproof washer is designed between the primary fan blade 102 and a lock nut separately, as well as between the primary fan blade 102 and the auxiliary fan blade 104, and is configured to absorb vibration generated by the two fan blades to reduce vibration and noise of the entire heat dissipation structure advantageously. The primary fan blade 102 is positioned to a D-shaped flat shaft on a motor shaft 1062 by a D-shaped hole in a center, and the auxiliary fan blade 104 is positioned to a hinge pin on the motor shaft 1062 by a clamping groove structure in the center. Finally, the primary fan blade 102, the auxiliary fan blade 104, and the two shockproof washers are locked onto the motor shaft 1062 by the fan lock nut, and the fan lock nut is fastened to the motor shaft 1062 by a threaded structure.

Furthermore, the motor 106 is fixed on a motor support 202 by a screw, the motor support 202 is fixed on a motor protective cover by a screw, and the motor protective cover is fixed on a head assembly of the entire heat dissipation structure by a screw. Moreover, a screw is designed on the motor protective cover to fix a rear net cover, and a screw and a hook structure are designed on the rear net cover to fix a front net cover.

According to the fan blade assembly and the fan apparatus according to the present disclosure, the maximum outer diameter of the primary fan blade is limited to be greater than the outer diameter of the auxiliary fan blade, and an effect of the auxiliary fan blade on the flow field of the primary fan blade may be reduced to ensure flow efficiency and reduce noise.

In the present disclosure, the terms "first", "second" and "third" are merely for descriptive purposes and should not be construed as indicating or implying relative importance; and the term "a plurality of" refers to two or more unless expressly specified otherwise. The terms "mount", "connected", "connect", "fix", etc. should be understood in a broad sense. For example, "connect" can be a fixed connection, a detachable connection, or an integrated connection; and "connected" may be a direct connection, or an indirect connection by an intermediate medium. The specific meanings of the above terms in the present disclosure can be understood according to specific circumstances.

In the description of the present disclosure, it should be noted that orientations or positional relations indicated by the terms "upper", "lower", "left", "right", "front", "back", etc. are based on the orientations or positional relations shown in the accompanying drawings and are merely for facilitating the description of the present disclosure and simplifying the description, rather than indicating or implying that a device or unit referred to must have a particular orientation or be constructed and operated in a particular orientation, and therefore will not be interpreted as limiting the present disclosure.

In the description of the present disclosure, the description of terms "an embodiment", "some embodiments", "particular embodiments", etc. means that a specific feature, structure, material or characteristic described in combination with the embodiment or examples are encompassed in at least one embodiment or example of the present disclosure. In the description, schematic expressions of the above terms do not necessarily refer to the same embodiment or example. Moreover, the specific feature, structure, material or characteristic described can be combined in a suitable manner in any one or more embodiments or examples.

What are described above are merely some embodiments of the present disclosure and are not intended to limit the present disclosure, which can be modified.

What is claimed is:

1. A fan blade assembly, comprising:

a primary fan blade with a plurality of first blades circumferentially arranged thereon;

an auxiliary fan blade adjacent coaxially to the primary fan blade, with a plurality of second blades circumferentially arranged thereon, the auxiliary fan blade having an air inlet direction that is an axial direction and an air outlet direction that is a radial direction, and the torsion direction of the first blades being different from that of the second blades; and a motor arranged on one side of the auxiliary fan blade away from the primary fan blade;

wherein the maximum outer diameter of the primary fan blade is greater than the outer diameter of the auxiliary fan blade; and wherein a hub diameter of the primary fan blade is greater than the maximum diameter of the auxiliary fan blade.

2. The fan blade assembly according to claim 1, wherein the auxiliary fan blade is arranged on the air inlet side of the primary fan blade.

3. The fan blade assembly according to claim 1, wherein the transparency of the primary fan blade is greater than 10%.

4. The fan blade assembly according to claim 1, further comprising:

a motor shaft arranged on the motor, wherein the primary fan blade is in transmission connection with the motor shaft of the motor, and the auxiliary fan blade is in transmission connection with the motor shaft.

5. The fan blade assembly according to claim 1, further comprising:

a first damping member arranged on one side of the primary fan blade facing the auxiliary fan blade; and/or a second damping member arranged on one side of the primary fan blade facing away from the auxiliary fan blade.

6. A fan apparatus, comprising:

a motor support; and a fan blade assembly, comprising:

a primary fan blade with a plurality of first blades circumferentially arranged thereon;

an auxiliary fan blade adjacent coaxially to the primary fan blade, with a plurality of second blades circumferentially arranged thereon, the auxiliary fan blade having an air inlet direction that is an axial direction and an air outlet direction that is a radial direction, and the torsion direction of the first blades being different from that of the second blades; and a motor arranged on one side of the auxiliary fan blade away from the primary fan blade;

wherein the maximum outer diameter of the primary fan blade is greater than the outer diameter of the auxiliary fan blade, wherein the fan blade assembly is arranged on the motor support; and wherein a hub diameter of the primary fan blade is greater than the maximum diameter of the auxiliary fan blade.

7. The fan apparatus according to claim 6, further comprising:

a first net cover and a second net cover that are detachable, connected to form an housing cavity, with the fan blade assembly arranged in the housing cavity;

wherein the first net cover is arranged on the air outlet side of the primary fan blade of the fan blade assembly, and the peripheral wall of the second net cover is provided with sound absorption sound absorption holes.

8. The fan apparatus according to claim 7, wherein the sound absorption sound absorption holes are arranged along the circumferential direction of the second net cover.

9. The fan apparatus according to claim 7, wherein the size of the sound absorption sound absorption holes are gradually increased or decreased along the axial direction of the fan blade assembly from the first net cover to the second net cover.

10. The fan apparatus according to claim 7, wherein the second net cover is arranged closer to a motor of the fan blade assembly than the first net cover, the first net cover is provided with a first transparent area, and the fan blade assembly is provided with a second transparent area.

11. The fan apparatus according to claim 6, wherein the auxiliary fan blade is arranged on the air inlet side of the primary fan blade.

12. The fan apparatus according to claim 6, wherein the transparency of the primary fan blade is greater than 10%.

13. The fan apparatus according to claim 6, further comprising:

a motor shaft arranged on the motor, wherein the primary fan blade is in transmission connection with the motor shaft of the motor, and the auxiliary fan blade is in transmission connection with the motor shaft.

14. The fan apparatus according to claim 6, further comprising:

a first damping member arranged on one side of the primary fan blade facing the auxiliary fan blade; and/or a second damping member arranged on one side of the primary fan blade facing away from the auxiliary fan blade.

* * * * *